US005623785A

United States Patent [19]

Mariel

[11] Patent Number: 5,623,785

[45] Date of Patent: Apr. 29, 1997

[54] WINDOW REGULATOR WITH TORSION SPRING ACTUATED DIRECT CABLE TENSIONING

[75] Inventor: James G. Mariel, Mishawaka, Ind.

[73] Assignee: Excel Industries, Inc., Elkhart, Ind.

[21] Appl. No.: 536,573

[22] Filed: Sep. 29, 1995

[51] Int. Cl.[6] ..... E05F 11/48

[52] U.S. Cl. ..... 49/352

[58] Field of Search ..... 49/348, 349, 352, 49/360; 74/501.5 R

[56] References Cited

U.S. PATENT DOCUMENTS

| | | | |
|---|---|---|---|
| 3,444,649 | 5/1969 | Rivolier . | |
| 4,090,329 | 5/1978 | Rampel . | |
| 4,235,046 | 11/1980 | Hess . | |
| 4,637,166 | 1/1987 | Ujihara | 49/352 |
| 4,878,391 | 11/1989 | Komatsu et al. | 49/352 X |
| 4,905,412 | 3/1990 | Srock et al. | 49/352 |
| 4,984,386 | 1/1991 | Marscholl . | |
| 5,074,077 | 12/1991 | Toyoshima . | |

FOREIGN PATENT DOCUMENTS

| | | | |
|---|---|---|---|
| 2802563 | 7/1979 | Germany | 49/352 |

*Primary Examiner*—Brian K. Green
*Assistant Examiner*—Jerry Redman
*Attorney, Agent, or Firm*—Banner & Witcoff, Ltd.

[57] ABSTRACT

A window regulator employs a drive cable to regulate opening and closing of a window in a vehicle. The drive cable is attached to a glider which is attached to the window, and extends around a loop which includes first and second guide elements and a drive drum. Rotation of the drive drum causes movement of the cable which in turn causes movement of the window. One of the guide elements is coupled to a torsion spring which causes the guide element to be forced outward to increase the circumference of the loop traveled by the cable and thereby to maintain tension on the cable. The guide element may take the form of a rotatable pulley.

20 Claims, 7 Drawing Sheets

WINDOW REGULATOR WITH TORSION SPRING ACTUATED DIRECT CABLE TENSIONING

FIELD OF THE INVENTION

The present invention is directed to a motor vehicle window regulator assembly. More particularly, the present invention is directed to a regulator assembly having a cable and drum sub-assembly for opening and closing a windowpane in a motor vehicle window opening.

BACKGROUND

Window regulators, which operate to open and close a moveably mounted window in a motor vehicle window opening, take a variety of forms including cable regulators which employ cables actuated by a drive means, such as a hand crank or electric motor. In cable regulators, a cable drive drum causes movement of the cable upon rotation of the drive drum by the drive means. The cable is generally attached in some form to the window and is guided by pulleys, conduits and other types of guide means to cause movement of the window upon rotation of the drive drum.

Maintaining tension on the cable in a cable operated window regulator is important to the proper operation of the regulator. A loose cable may slip from any of the guides, causing failure of the system. In addition, a loose cable will also cause increased stress on the cable and other portions of the system resulting in uneven motion of the cable when movement of the window is initiated or when the direction of movement of the window is suddenly reversed.

A known approach to maintaining tension on the cable includes the application of a tensioning force to a conduit which encloses the cable. The tensioning force is typically applied by a spring against the conduit and indirectly causes tension in the cable by increasing the travel length of the cable. Unfortunately, the indirect tensioning of the cable by the aforesaid approach can cause increased wear on the conduit. In addition, the spring actuated mechanisms which act upon the conduit often substantially increase the complexity of the regulator, thus increasing the fixed cost of the regulator in addition to increasing the manufacturing complexity.

U.S. Pat. No. 4,235,046 entitled *Window Operating Mechanism* to Hess et al. discloses a cable tensioning device which applies a tensioning force directly to the cable. In FIG. 2 of Hess, a tension spring 16 appears to apply a force to a pulley 5 to create tension in a cable 3. A pawl-and-ratchet device prevents return motion of the pulley when the cable is under compression. While the device of FIG. 2 in Hess maintains tension on the cable, it appears to do so only in one direction. Tension on the cable is increased, and maintained by the ratchet-and-pawl device, but is not decreased. The result may be excessive tension on the cable, which increases friction and wear and requires greater force to lift the window. Moreover, such device does not adequately self-adjust for sudden changes in loading, such as when the window operator starts to open a window and then abruptly closes the window. There is accordingly, a need for a window regulator assembly which overcomes the deficiencies noted above.

It is an object of the present invention to provide a window regulator assembly which maintains adequate tension on a drive cable in the assembly used to obtain movement of the window, while reducing the attendant complexity, cost and component wear introduced by systems as described above. This object and other objects of the invention will be apparent from the following disclosure and detailed description of certain preferred embodiments.

SUMMARY

In accordance with a first aspect, a window regulator assembly, for regulating the opening and closing of a vehicle window, which is slidably mounted in a motor vehicle body window aperture includes a first glider attached to the windowpane and slidably mounted to an elongated first track. A first cable guide means is attached to a first position on the first track and a first bracket is mounted to a second position on the first track. A second cable guide means is coupled to the first bracket. A cable which is attached to the first glider extends in a path around the first cable guide means, the second cable guide means and a rotatable cable drive means which moves the cable upon rotation of the cable drive means. A torsion spring which is coupled to the first bracket and to the second cable guide means, causes tension in the cable by forcing the second cable guide means outward from the path to extend the circumference of the path traveled by the cable.

Embodiments utilizing the principles of the invention described herein offer significant advantages over the systems described above. The second cable guide means maintains appropriate tension on the cable when the window is being either raised or lowered. The torsion spring allows tension on the cable to be either decreased or increased as needed. Moreover, assembly of the cable regulator is simplified.

In a further aspect of the invention, the first and second guide means take the form of pulleys which rotate to minimize friction as the cable is moved. The second cable guide means and torsion spring may preferably be coupled in one of two forms. In one embodiment the torsion spring is directly coupled to the second cable guide means, while in another embodiment, the torsion spring is coupled to the second cable guide means via an arm. The principles of the present invention also include alternative mechanisms for coupling the torsion spring to the guide means. Moreover, the use of additional tracks and guide means to support larger windows may also be employed within the principles of the invention described in further detail below.

Additional features and advantages of various preferred embodiments will be better understood from the following detailed discussion.

BRIEF DESCRIPTION OF THE DRAWINGS

Certain preferred embodiments of the invention are discussed below with reference to the appended drawings wherein:

FIGS. 6(*b*) and 6(*c*) are simplified schematic diagrams of alternatives to the embodiment shown in FIG. 6(*a*);

FIGS. 7(*b*) and 7(*c*) are simplified schematic diagrams of alternatives to the embodiment shown in FIG. 7(*a*);

FIGS. 8(*b*) and 8(*c*) are simplified schematic diagrams of alternatives to the embodiment shown in FIG. 8(*a*).

Figure 1:
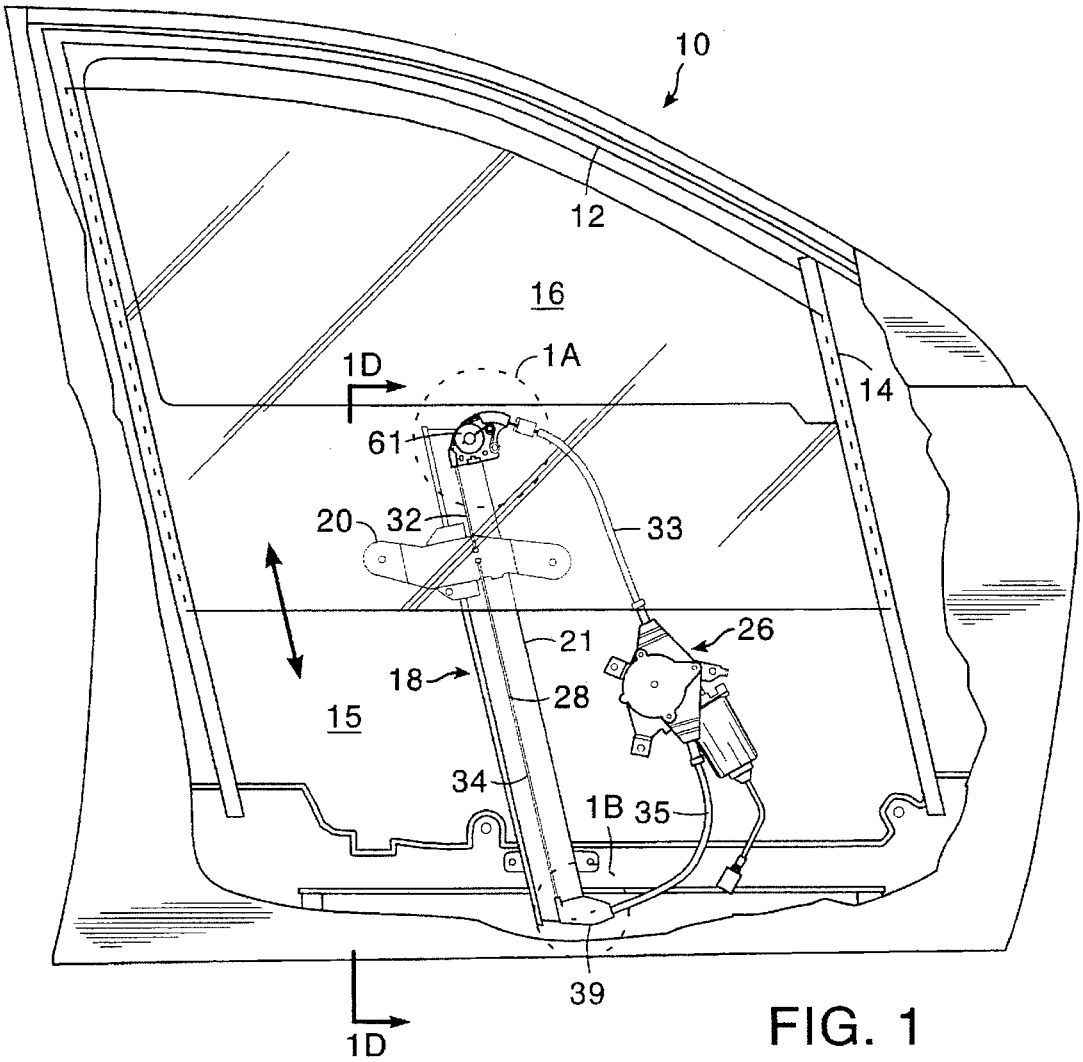
FIG. 1 is a schematic elevation view of a motor vehicle door defining a window opening in which is mounted a vertically slidable windowpane having a regulator assembly comprising a cable and drum subassembly in accordance with a first preferred embodiment.

The figures referred to above are not drawn necessarily to scale and should be understood to present a simplified representation of the invention, illustrative of the basic principles involved. Window assemblies incorporating the novel cable and drum drive assemblies will have configurations and components determined, in part, by the intended application and use environment. Some features of the window assembly depicted in the accompanying figures have been enlarged or distorted relative to others to facilitate visualization and understanding. In particular, thin features may be thickened and long features may be shortened. References to direction and position, unless otherwise indicated, refer to the orientation of the window assembly illustrated in the drawings.

DETAILED DESCRIPTION OF CERTAIN PREFERRED EMBODIMENTS

In view of the above disclosure, those who are skilled in this area of technology will recognize that the novel window regulator assemblies as heretofore described can be used for operating motor vehicle windows which are movably mounted in a variety of different ways. They are applicable, for example, to horizontally slidable windows as well as vertically slidable windows. The following discussion of certain preferred embodiments focuses on window assemblies wherein the windowpanes are opened and closed by a vertical sliding action, but the design and operating principles are applicable generally to motor vehicle windows which have alternative open/close mechanisms. Similarly, although the discussion below focuses on a vertically sliding window in a motor vehicle door, the novel window regulator assemblies are applicable also, for example, to motor vehicle backlites, including picktup truck backlites, wherein many of the same constraints are applicable, such as space limitations, reliability requirements, etc.

Referring now to the window regulator assembly depicted in the appended drawings, FIG. 1 shows a preferred window regulator assembly 18 which operates in a pull/pull manner to open and close transparent glazing panel 16. In FIG. 1, a motor vehicle door 10 is shown schematically to define a window opening 12 fitted with a window frame 14 in accordance with known motor vehicle body designs and components. Transparent glazing panel 16, which is formed typically of glass or plastic, or a multilayer laminate of such materials, is vertically slidably mounted in window opening 12. More specifically, the peripheral edges of glazing panel 16 are received in a track formed by window frame 14 extending downwardly into the door cavity 15 below the so-called beltline of window opening 12. The window is vertically slidable between its open and closed positions by actuation of window regulator assembly 18.

Figure 1B:
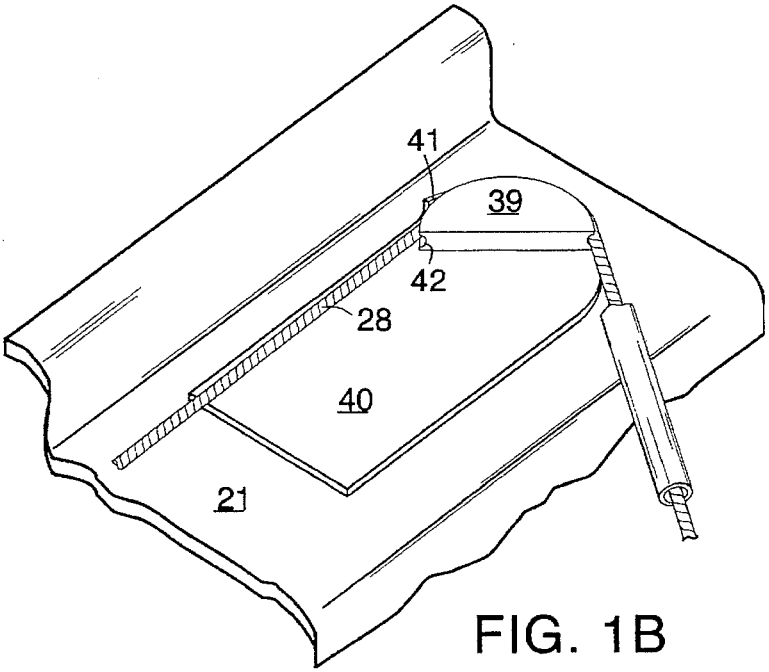
FIG. 1B is an enlarged view of the portion of FIG. 1 contained within the dotted circle designated by reference number 1B.

Window regulator assembly 18 comprises a glider 20 fitted to the lower peripheral edge of glazing panel 16 in accordance with known attachment techniques including, for example, adhesives and through-hole fasteners. Glider 20 is mounted for vertical travel on track 21, which is mounted in fixed position within door cavity 15. By traveling vertically up and down track 21, glider 20 carries glazing panel 16 upward to its closed position in window opening 12 or downward, to its open position. As seen in FIG. 1D track 21 is curved.

The position of glider 20 along vertical track 21 and, hence, the position of glazing panel 16 within window opening 12, is controlled by the cable and drum subassembly 26 mounted within door cavity 15. This subassembly includes cable 28 which operates in a pull/pull manner to regulate the window position. That is, cable 28 extends in a closed loop, partially within cable guide conduits 33 and 35 to pull the window upward to its closed position and to pull the window downward to its open position. Cable 28 is preferably two separate cables each of which is attached at a first end to glider 20 and at a second end to a drum 44 within drive means 26. Alternatively, cable 28 may be a single cable which is attached at both ends to glider 20. An up-pulling portion 32 of cable 28 extends upwardly from glider 20 to the drum subassembly 26 and acts, when driven by the drive means of the subassembly 26 discussed immediately below, to pull glazing panel 16 via bracket 20 and upwardly toward its closed position. Correspondingly, down-pulling portion 34 of cable 28 extends downwardly from glider 20 to the drum subassembly 26 to pull glazing panel 16 downwardly toward its open position.

Cable guide conduits 33 and 35 enclose cable 28 and protect the cable from abrasion and also provide guide paths for the cable. Cable guide conduit 33 is positioned between glidable guide means 61 and subassembly 26. Cable guide conduit 35 is positioned between fixed guide means 39 and subassembly 26.

In operation, cable 28 wears a path in conduits 33 and 35. The slidable pulley mechanism described in detail below advantageously compensates for any slack which occurs by cable wear including wear of conduits 33 and 35.

Figure 1A:
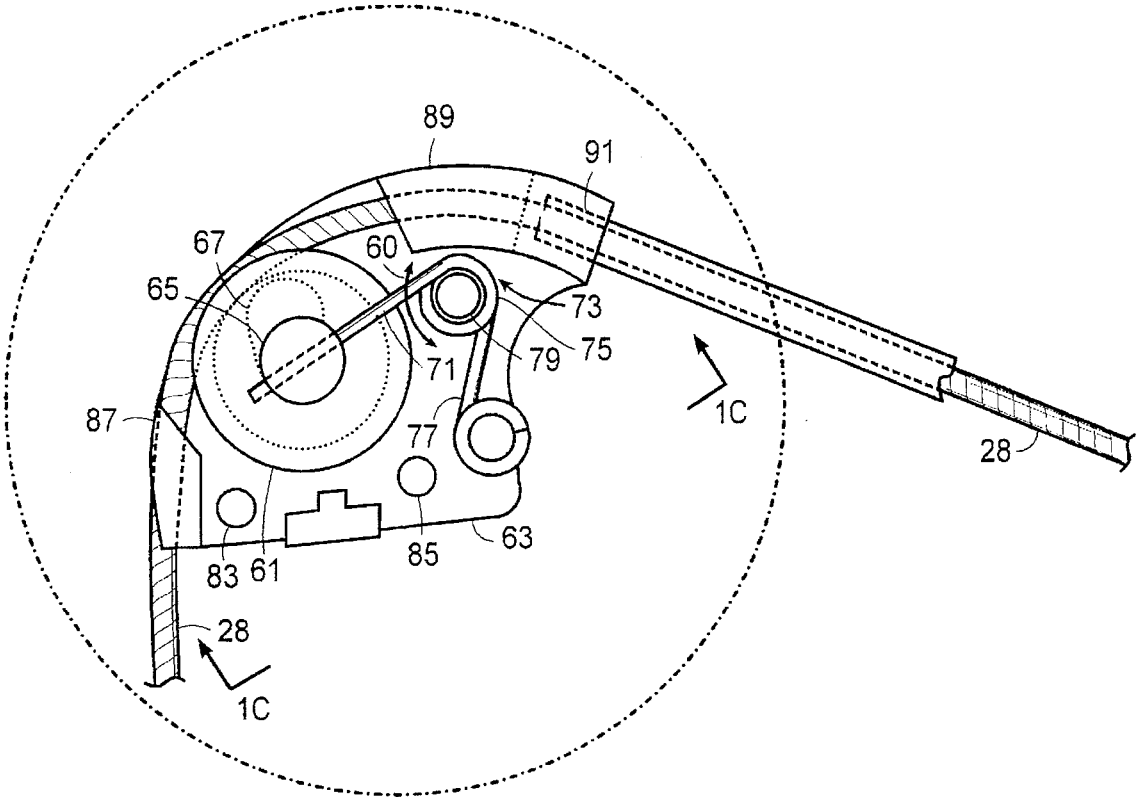
FIG. 1A is an enlarged and exploded view of the portion of FIG. 1 contained within the dotted circle designated by reference number 1A.
Figure 1C:
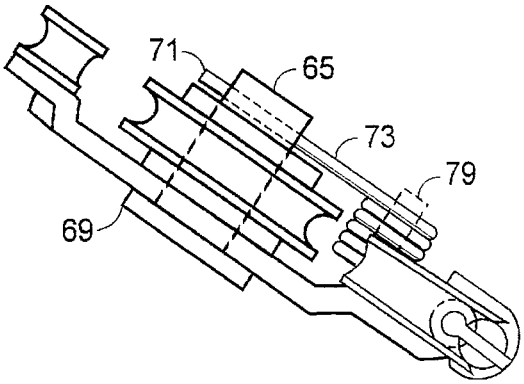
FIG. 1C is side view along the line 1C—1C of FIG. 1A.
Figure 1D:
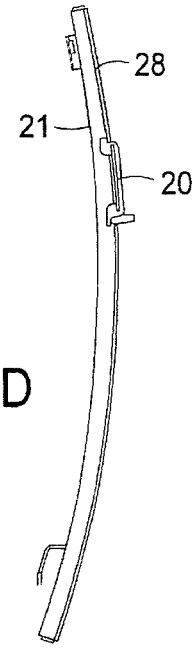
FIG. 1D is a side view along the line 1D—1D of FIG. 1.

Cable guide means 61 is shown in greater detail in FIG. 1A which is an expanded view of the area enclosed by dotted circle 1A in FIG. 1. FIG. 1C shows a side view of FIG. 1A along the line 1C—1C in FIG. 1A. Pulley 61 is coupled to a bracket 63 by a pulley shaft 65 which is disposed in a pulley shaft guide slot 67. Pulley shaft 65 is retained within pulley shaft guide slot 67 by means of a T-shaped end 69 and a first extended arm 71 of torsion spring 73, which extends through the pulley shaft 65. As seen in FIG. 1A, first extended arm moves in an arc 60 about peg 79. Guide slot 67 is preferably positioned and is of sufficient length to allow pulley 61 to move along a portion of the arc. While the arc about peg 79 is curved, guide slot 67 need not be concentric with the arc so long as the guide slot is short enough to allow pulley 61 to travel only along a straight line portion of the arc. The movement of pulley 61 in guide slot 67 allows the torsion spring 73 to adjust tension in the spring by changing the effective circumference of the loop 17 traveled by the cable 28. The variable torsion provided by pulley 61 advantageously facilitates assembly of the cable regulator 18 by allowing the cable to be fitted at one end to the drive assembly 26, wrapped around the pulley 61 and be fitted at the opposite end to the glider. Upon fitting of the cable 28 at both ends, the torsion spring 73 causes the pulley 61 to hold the cable taut. Changes in the effective length of the cable which may occur due to wear in conduits 33 and 35 and wear at the mounting ends of the cable are compensated for by the pulley 61 which causes the circumference of the loop 17 traveled by the cable to increase as required to maintain tension on the cable.

The torsion spring 73 is preferably formed of steel and includes a coiled portion 75, first extended arm 71, and second extended arm 77. The coiled portion 75 is mounted to bracket 63 by means of peg 79 which is integral with the bracket 63. First extended arm 71 fits tightly within pulley shaft 65 and second extended arm 77 is fitted tightly around peg 81 which is integral with bracket 63. The bracket 63 is preferably formed of molded nylon and is mounted to track 21 by bolts which extend through mounting holes 83 and 85. The bracket advantageously has cable guides 87 and 89 formed integrally with the bracket to guide the cable 28 into and out of pulley 61. Cable guide 89 has formed therein an opening 91 which is sized to accept and form a tight fit with conduit 33.

FIG. 1B shows an expanded view of the area within dotted line 1B in FIG. 1 which encircles fixed cable guide 39. Fixed cable guide 39 is mounted to track 21 by means of a plate 40 which is bolted or welded to the track 21. Plate 40 has formed thereon a lip 41 which is concentric with a portion of fixed cable guide 39. Lip 41 retains cable 28 in the channel 42 in the cable guide 39 during abrupt changes in movement of the cable which may cause momentary looseness of the cable.

Figure 2:
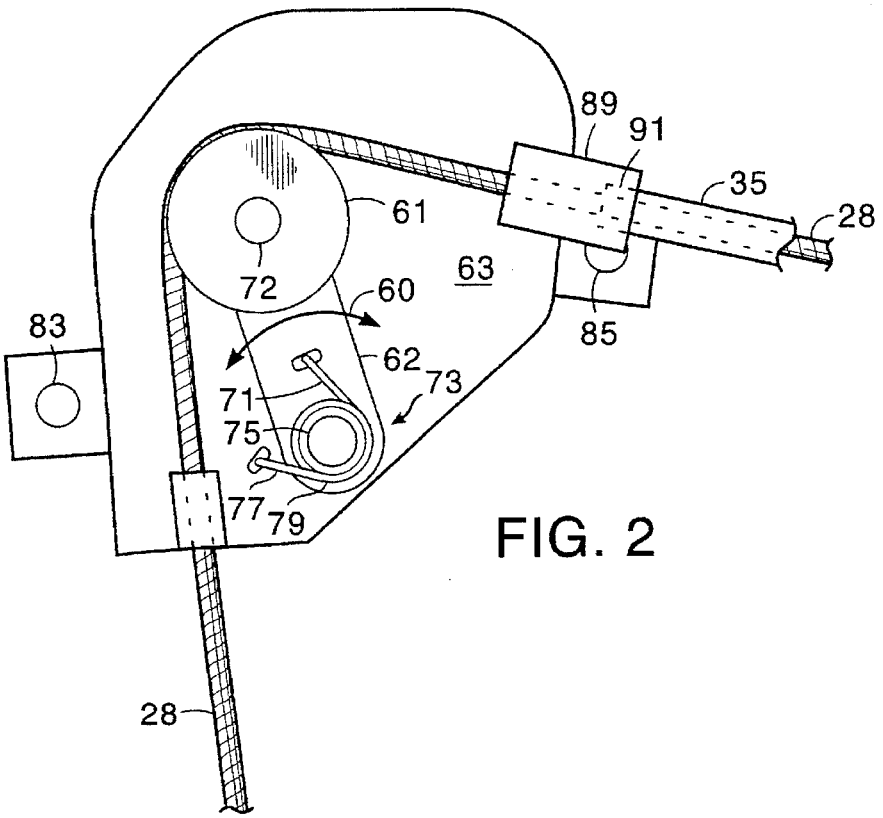
FIGS. 2 and 3 are alternative embodiments to the portion of FIG. 1 shown in FIG. 1A.
Figure 3:
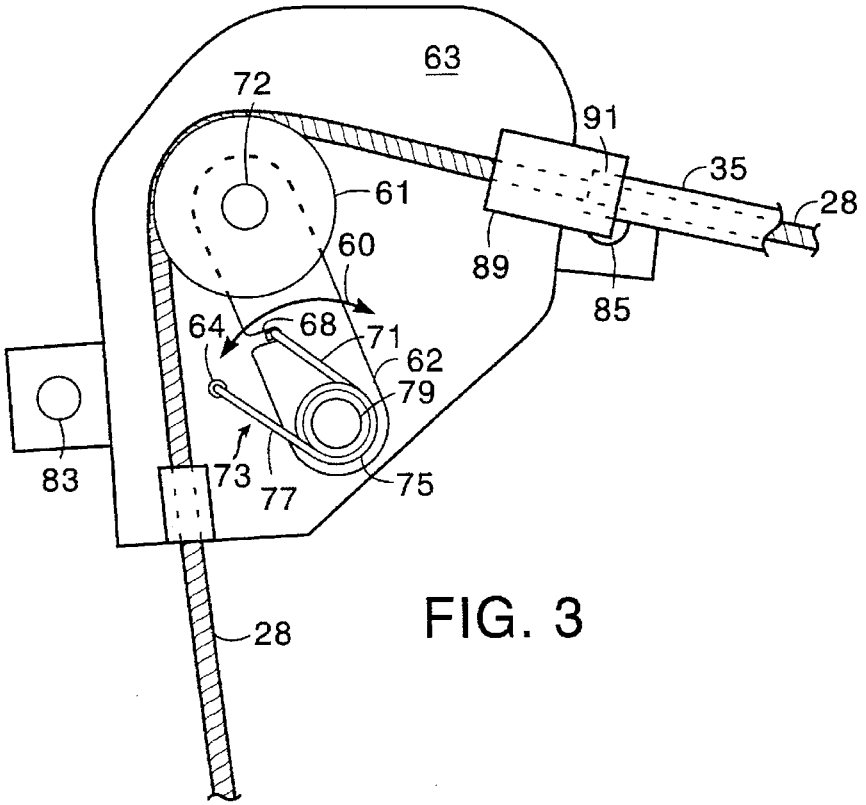

FIGS. 2 and 3 show expanded views of alternative embodiments to the pulley and bracket assembly shown in FIGS. 1A and 1C. The embodiments of FIGS. 2 and 3 utilize an arm 62 to couple pulley 61 in a rotatable fashion around peg 79. Arm 62 is rotatably coupled to peg 79 by conventional means, and coiled portion 75 is tightly fitted to peg 79. First extended arm 71 of torsion spring 73 is attached to arm 62 and second extended arm 77 is attached to bracket 63. The bracket 63 includes a cable guide 89 and conduit holder 91 as described above for FIG. 1A. Mounting holes 83 and 85 allow mounting of the bracket 63 to track 21. The embodiments shown in FIGS. 2 and 3 are similar except for the attachment of first extended arm 71 to arm 62. In FIG. 2, first extended arm 71 is attached to arm 62 by extending arm 71 through arm 62 and crimping arm 71. In FIG. 3, first extended arm 71 extends into a notch 68 formed in arm 62, as seen in greater detail in FIG. 3A. Torsion caused by the coiled portion 75 maintains the arm 71 in the notch 68.

As with the embodiment shown in FIG. 1 A, the embodiments of FIGS. 2 and 3 advantageously facilitate assembly of the cable regulator 18 and maintain tension in the cable 28 during operation of the cable regulator 18. Torsion spring 73 causes pulley 61 to move along the arc seen at 60 to increase the circumference of the loop 17 in order to maintain tension in the cable 28 as needed.

Figure 4:
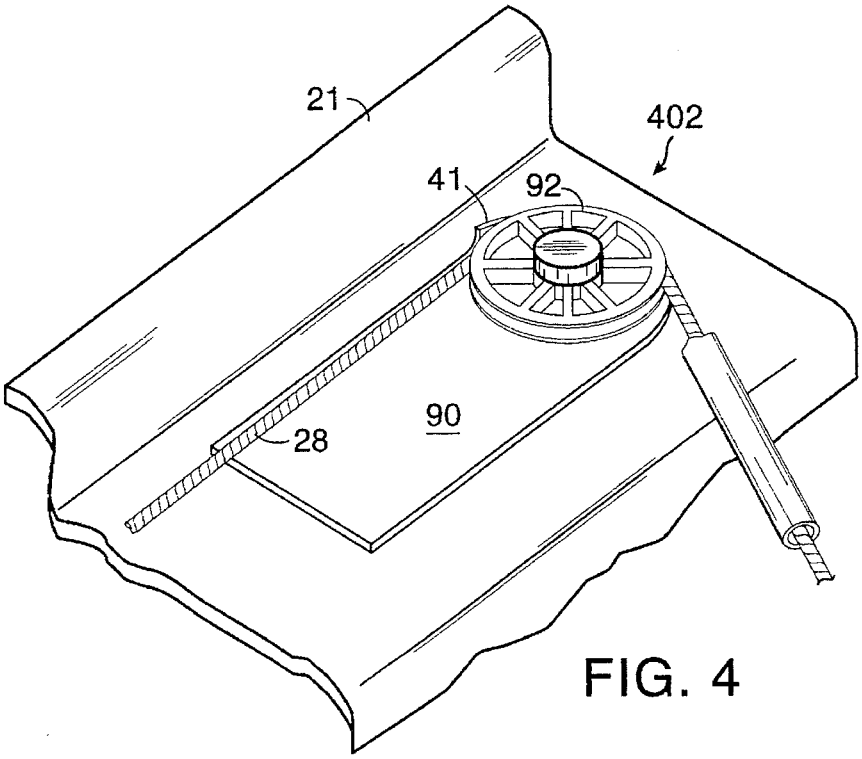
FIG. 4 is an alternative embodiment to the portion of FIG. 1 shown in greater detail in FIG. 1B.

FIG. 4 of the drawings shows an alternative to the embodiment of FIG. 1B. As seen in FIG. 4, a pulley 92 replaces the fixed cable guide 39 of FIG. 1B. Lip 41 formed on the pulley plate 90 retains cable 28 during abrupt transitions in the movement of the cable 28. The pulley 92 decreases friction on the cable 28.

Cable 28 is driven either manually by means of a hand crank coupled to drum subassembly 26, or (as seen in FIG. 1) electrically by means of an electric motor contained within drive housing 40. Cable 28 preferably takes the form of two cables each of which have a first end connected to glider 20 and a second end connected to a drum contained within drive housing 40. Rotation of the drum in a clockwise or counterclockwise direction causes movement of the cable. Alternatively, cable 28 may be a single piece of cable which is connected at both ends to glider 20 and is wound in multiple wraps around the drum.

Numerous suitable cable materials are available for drive cable 28 including, for example, twisted, multi-filament steel cable. For regulator assemblies employing drive means comprising an electric motor, drive cable 28 more preferably is higher tensile strength braided steel cable. It will be well within the ability of those skilled in this area of technology to select suitable, commercially available material for drive cable 28.

Figure 5A:
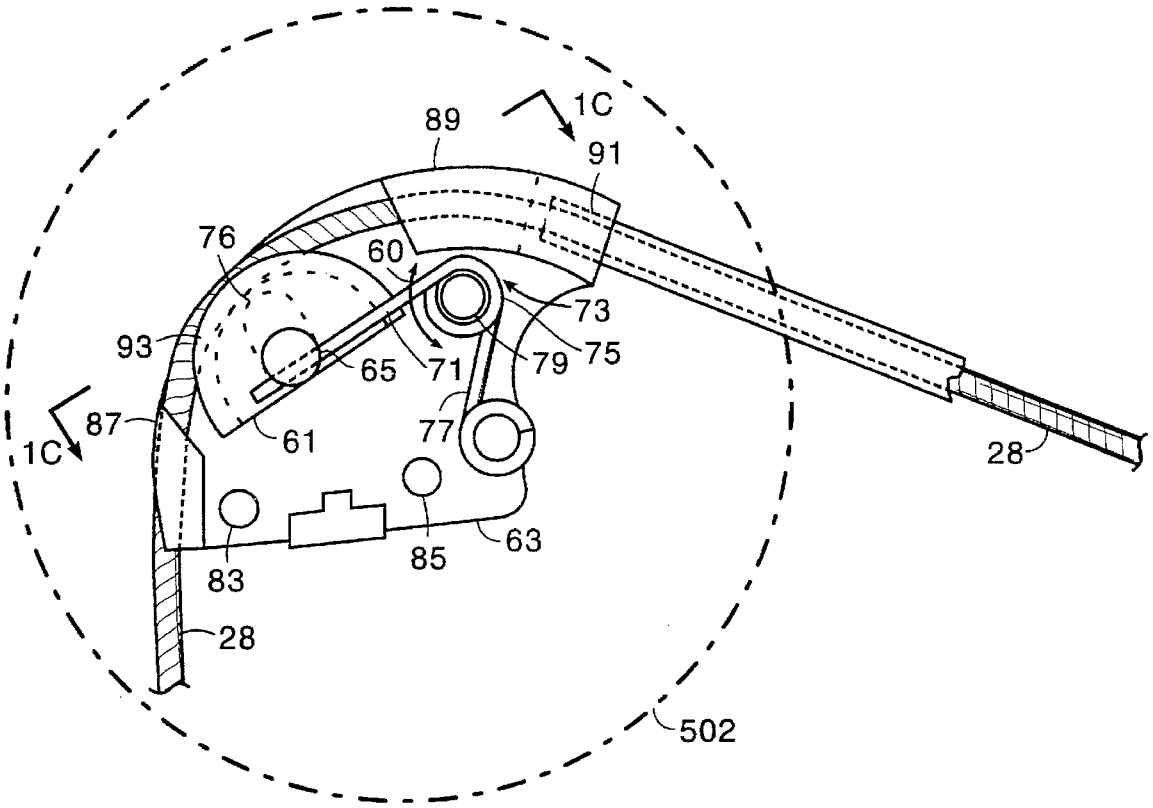
FIGS. 5(*a*), 5(*b*) and 5(*c*) are alternative embodiments to the portion of FIG. 1 shown in FIGS. 1A, FIG. 2 and FIG. 3 respectively.
Figure 5B:
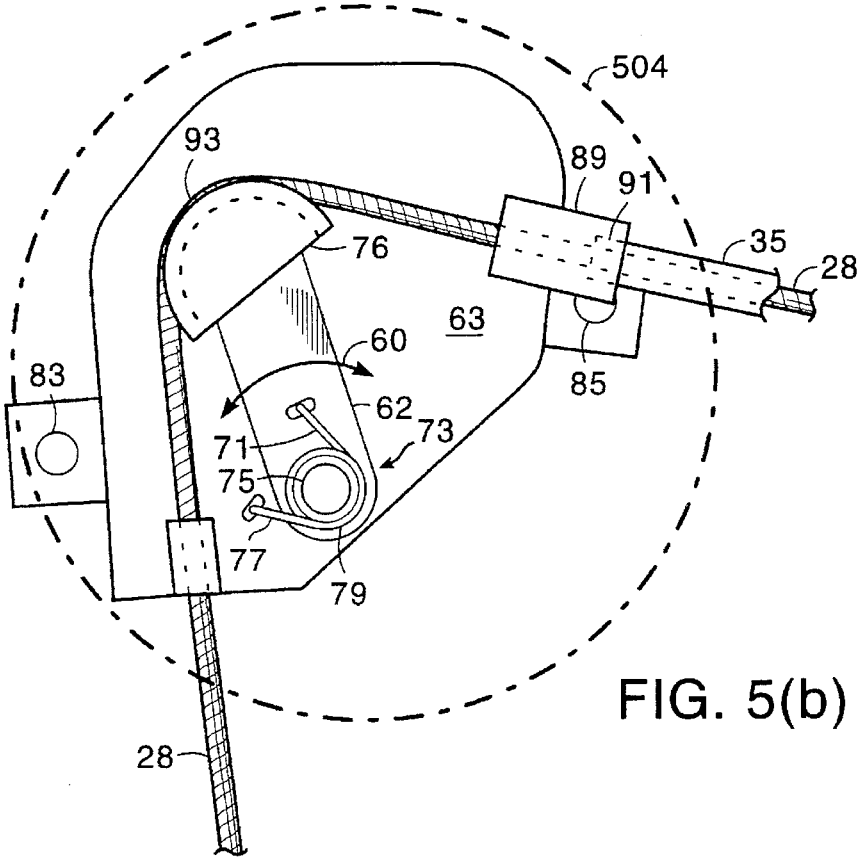
Figure 5C:
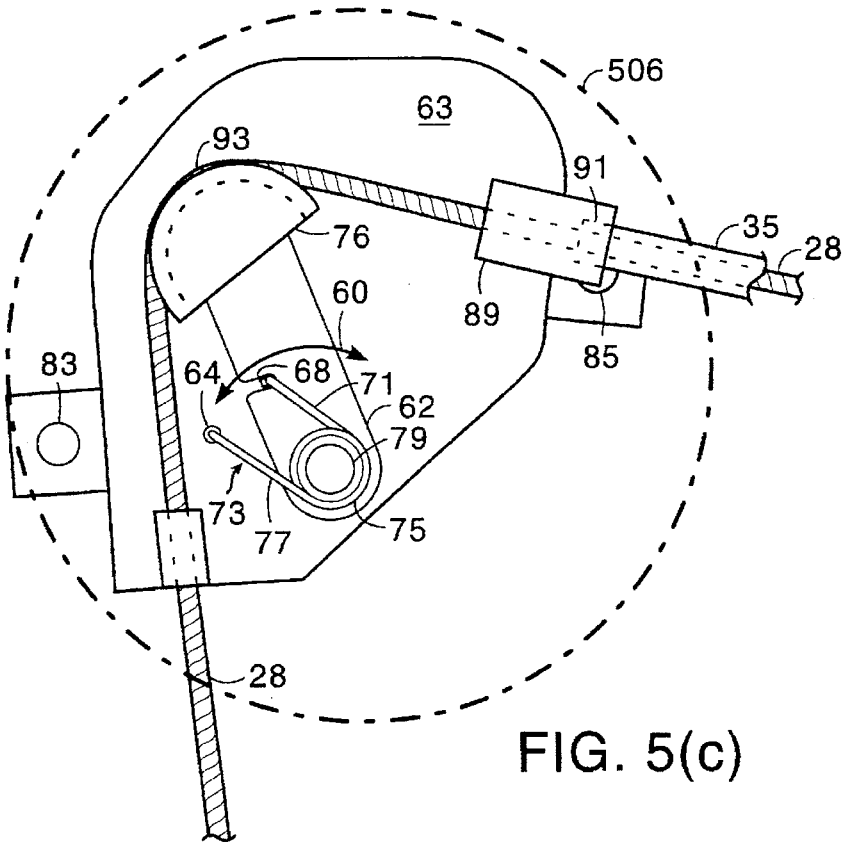

FIGS. 5(*a–c*), 6(*a–c*), 7(*a–c*) and 8(*a–c*) show alternative embodiments which utilize the principles of the invention. FIGS. 5(*a–c*) show alternative embodiments of the assemblies shown in FIGS. 1A, 2 and 3. In FIGS. 5(*a*), 5(*b*) and 5(*c*), the pulley 61 of FIGS. 1A, 2 and 3 is replaced by a fixed cable guide 76 which has a channeled outer portion 93 to guide cable 28. The fixed cable guide 76 increases the friction on cable 28 as it moves along the channeled outer portion 93, but may provide a lower cost alternative to the pulley 61. The operation and structure of FIGS. 5(*a*), 5(*b*) and 5(*c*) is otherwise, the same as that explained above for FIGS. 1A, 2 and 3 respectively.

Figure 6A:
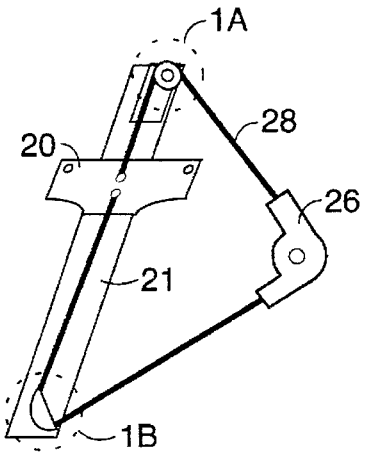
FIGS. 6(*a*) is a simplified schematic diagram of the embodiment shown in FIG. 1.
Figure 6B:
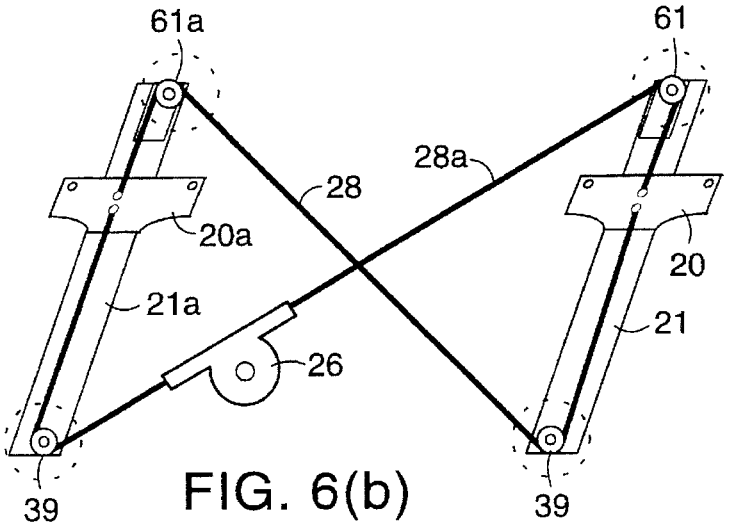
Figure 6C:
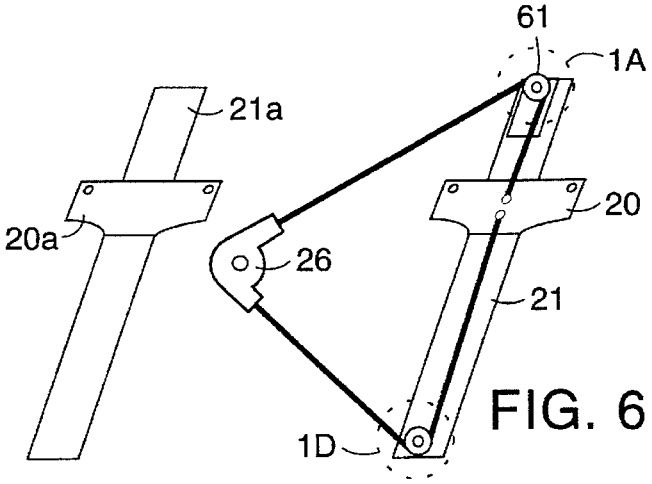

FIG. 6(*a*) shows a simplified schematic view of the cable regulator assembly or FIG. 1, and FIGS. 6(*b*) and 6(*c*) show alternative arrangements which utilize the principles of the invention described above with reference to FIG. 1. FIG. 6(*b*) shows a dual-track cable regulator assembly which employs a first track 21 and a second track 21*a*. The dual tracks shown in FIG. 6(*b*) are preferable for use with large windows which require additional support. Gliders 20 and 20*a* are mounted on tracks 21 and 21*a* respectively. Cable 28 takes the form of two separate cables, 28*a* and 28*b* which are each coupled at a first end to glider 20 and at a second end to glider 20*a*. Cable 28*b* is wound in multiple wraps around a drum in drive assembly 26. Rotation of the drum in drive assembly 26 in a first direction causes cables 28*a* and 28*b* to move gliders 20 and 20*a* upward and rotation of the drum in a second direction causes cables 28 and 28*a* to move gliders 20 and 20*a* downward. The dual-track cable regulator of FIG. 6(*b*) employs fixed rotatable pulleys 39 and 39*a* of the type seen in FIG. 4 at lower ends of tracks 21 and 21*a* and, rotatable pulleys 61 and 61*a* of the type seen in FIG. 1A, at upper ends of tracks 21 and 21*a*. Rotatable pulley 61*a* reduces slack in cable 28 which occurs at the attachment of the cable to gliders 20 and 20*a*. Rotatable pulley 61 performs a similar function, and also advantageously reduces slack in cable 28*a* caused by changes of direction of the drum in drive assembly 26. As seen in FIG. 6(*b*) pulleys 61 and 61*a* take a form as shown in greater detail in FIGS. 1A, 2 or 3. Pulleys 39 and 39*a* take form as shown in greater detail in FIG. 4.

FIG. 6(*c*) of the drawings shows a slave track window regulator assembly which employs a primary track 21 and a secondary track 21*a*. The slave track assembly shown in FIG. 6(*c*) offers greater support to a window than provided in the embodiment shown in FIG. 6(*a*), but at a lower cost than the assembly of FIG. 6(*b*). In FIG. 6(*c*), movement of cable 28 causes direct movement of glider 21 and indirect movement of glider 21*a*. The assembly of FIG. 6(*c*) employs a fixed rotatable pulley 39 at a lower end of track 21 and a rotatable pulley 61 at a upper end of track 21. As seen in FIG. 6(*c*) pulley 61 takes a form as shown in greater detail in FIGS. 1A, 2 or 3 and pulley 39 takes a form as shown in greater detail in FIG. 4.

Figure 7A:
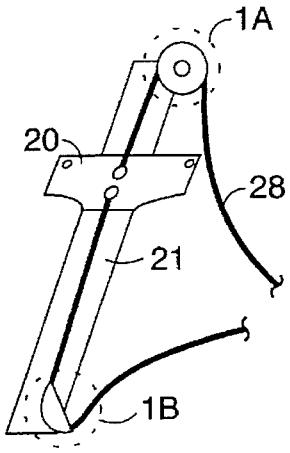
FIG. 7(*a*) is a simplified schematic diagram of the embodiment shown in FIG. 1.
Figure 7B:
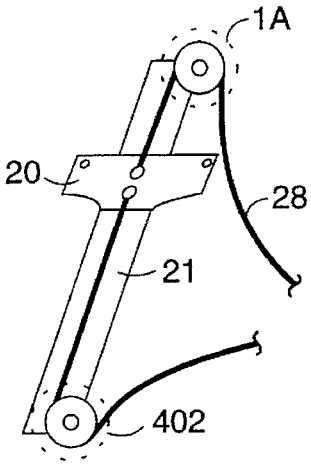
Figure 7C:
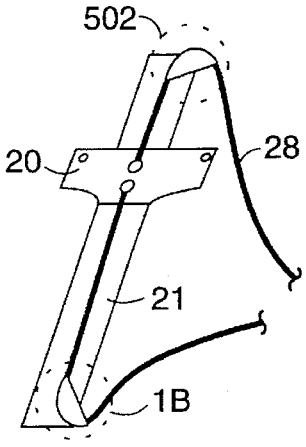

FIGS. 7(*a–c*) show alternative positions and combinations of guide means which may be employed in accordance with the principles of the invention. FIG. 7(*a*) shows a simplified schematic view of FIG. 1 in which the guide means used by the cable regulator assembly take the form of the guide means shown in FIGS. 1A, 2 or 3 at the upper end of track 21, and the guide means shown in FIG. 1B at the lower end of track 21. FIG. 7(*b*) shows a simplified schematic view of an alternative embodiment which employs a rotatable pulley at lower and upper ends of track 21. In FIG. 7(*c*), cable guides are utilized at both ends of the track. In FIG. 7(*b*), the guide means at the upper end of track 21 takes a form as shown in FIG. 1A, or alternatively, as seen in FIGS. 2 and 3, and the guide means at the lower end of track takes a form as shown in FIG. 4. In FIG. 7(*c*), the guide means at the upper end of track 21 takes a form as shown in FIG. 5(*a*), and the guide means at the lower end of track 21 takes a form as shown in FIG. 1B.

Figure 8A:
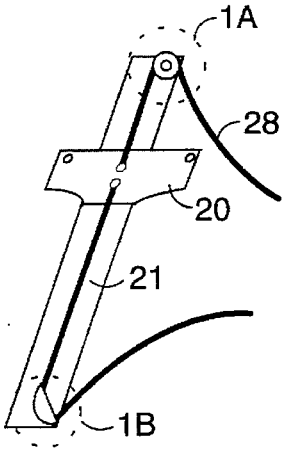
FIG. 8(*a*) is a simplified schematic diagram of the embodiment shown in FIG. 1.
Figure 8B:
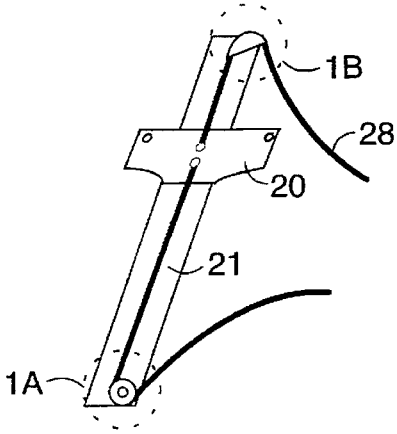
Figure 8C:
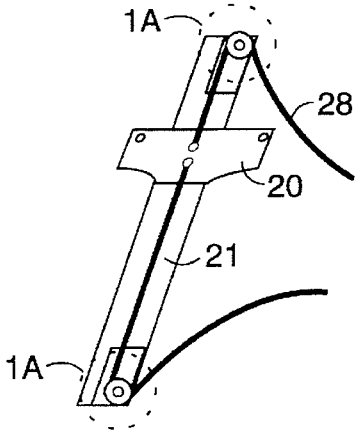

FIGS. 8(*a–c*) show alternative positions and combinations of the rotatable pulley of FIG. 1A and the fixed cable guide of FIG. 1B. FIG. 8(A) shows the embodiment shown in FIG. 1, which employs a slidable rotatable pulley at an upper end of track 21 and a fixed cable guide at a lower end of track 21. In FIG. 8(*b*), the position of the pulley and cable guide in FIG. 8(*a*) is reversed with a fixed cable guide pulley at an upper end of track 21 and a rotatable pulley, as shown in FIGS. 1A, 2 or 3 at a lower end of track 21. FIG. 8(*c*) shows a window regulator assembly which employs rotatable pulleys at each end of track 21 as seen in FIGS. 1A, 2 or 3.

In light of the foregoing disclosure of the invention and description of certain preferred embodiments, those who are skilled in this area of technology will readily understand that various modifications and adaptations can be made without departing from the true scope and spirit of the invention.

The relationship of the components shown in FIG. 1 may also be varied without departing from the true scope and spirit of the invention. For example, the position of subassembly 26 may be raised, lowered, or moved further away or closer to the pulleys 39 and 61. In addition, the shape of conduits 39 and 61 may be changed in order to change the path of travel of the cable. Additional pulleys or fixed cable guides may also be used to guide the cable. Further modifications and adaptations are also intended to be covered by the following claims.

What is claimed is:

1. A window regulator assembly comprising, in combination:

a first glider attached to a windowpane and slidably mounted to an elongated first track;

first cable guide means attached to a first position on said first track;

a first bracket mounted to a second position on said first track;

second cable guide means coupled to said first bracket;

a cable attached to said first glider and extending in a path around said first cable guide means, said second cable guide means and a rotatable cable drive means which moves said cable upon rotation of said cable drive means; and a torsion spring coupled to said first bracket and directly coupled to said second cable guide means to cause tension in said cable by forcing said second cable guide means outward from said path to extend the path traveled by said cable.

2. A window regulator assembly as set forth in claim 1 further comprising an arm having a first end and a second end, said first end being coupled to said second cable guide means and said second end being rotatably coupled to said first bracket.

3. A window regulator assembly as set forth in claim 2 wherein the torsion spring comprises a coiled portion and a first arm and a second arm extending from said coiled portion, said first arm of said torsion spring coupled to said first bracket and said second arm of said torsion spring being fitted into a notch formed in said arm.

4. A window regulator assembly as set forth in claim 3 wherein the second cable guide means is a pulley.

5. A window regulator assembly as set forth in claim 4 wherein said first cable guide means is a pulley.

6. A window regulator assembly as set forth in claim 5 further comprising:

a first conduit which encloses said cable and which is positioned between said first cable guide means and said rotatable cable drive means, said first conduit fitted at a first end to a conduit holder formed in said first bracket and a second conduit which encloses said cable and which is positioned between said second cable guide means and said rotatable cable drive means.

7. A window regulator assembly as set forth in claim 6 wherein the first bracket has formed thereon, a first cable guide and a second cable guide for guiding said cable into and out of said cable guide means.

8. A window regulator assembly as set forth in claim 7 further comprising:

a second glider attached to said windowpane and slidably mounted to an elongated second track positioned substantially parallel to said first track;

third cable guide means attached to a first position on said second track;

a second bracket mounted to a second position on said second track;

fourth cable guide means, coupled to said second bracket, said cable being attached to said second glider and extending around said third cable guide means and said fourth cable guide means; and a second torsion spring coupled to said second bracket and to said fourth cable guide means, said torsion spring causing tension in said cable by forcing said fourth cable guide means outward from said path to extend the distance traveled by said cable.

9. A window regulator assembly as set forth in claim 8 wherein said second and fourth guide means are pulleys.

10. A window regulator assembly as set forth in claim 7 further comprising a second glider attached to said windowpane and slidably mounted to an elongated second track positioned substantially parallel to said first track.

11. A window regulator assembly as set forth in claim 1 further comprising a shaft fitted to said second guide means, said shaft extending through a guide slot formed in said bracket, said shaft coupled at a first end to said torsion spring and slidably coupled at a second end in said guide slot.

12. A window regulator assembly as set forth in claim 11 wherein said first cable guide means is a pulley.

13. A window regulator assembly as set forth in claim 12 further comprising:

a first conduit which encloses said cable and which is positioned between said first cable guide means and said rotatable cable drive means, said first conduit fitted at a first end to a conduit holder formed in said first bracket; and a second conduit which encloses said cable and which is positioned between said second cable guide means and said rotatable cable drive means.

14. A window regulator assembly as set forth in claim 13 wherein the first bracket has formed thereon, a first cable guide and a second cable guide for guiding said cable into and out of said cable guide means.

15. A window regulator assembly as set forth in claim 14 further comprising:

a second glider attached to said windowpane and slidably mounted to an elongated second track positioned substantially parallel to said first track;

third cable guide means attached to a first position on said second track;

a second bracket mounted to a second position on said second track;

fourth cable guide means, coupled to said second bracket, said cable being attached to said second glider and extending around said third cable guide means and said fourth cable guide means; and a second torsion spring coupled to said second bracket and to said forth cable guide means, said torsion spring causing tension in said cable by forcing said fourth cable guide means outward from said path to extend the distance traveled by said cable.

16. A window regulator assembly as set forth in claim 15 wherein said second and forth guide means are pulleys.

17. A window regulator assembly as set forth in claim 1 further comprising:

a second glider attached to said windowpane and slidably mounted to an elongated second track positioned substantially parallel to said first track;

third cable guide means attached to a first position on said second track;

a second bracket mounted to a second position on said second track;

forth cable guide means, coupled to said second bracket, said cable being attached to said second glider and extending around said third cable guide means and said fourth cable guide means; and a second torsion spring coupled to said second bracket and to said forth cable guide means, said torsion spring causing tension in said cable by forcing said fourth cable guide means outward from said path to extend the distance traveled by said cable.

18. A window regulator assembly as set forth in claim 17 wherein said second and fourth guide means are pulleys.

19. A window regulator assembly comprising, in combination:

a first glider attached to a windowpane and slidably mounted to an elongated first track;

a first pulley attached to a first position on said first track;

a first bracket mounted to a second position on said first track;

a second pulley coupled to said first bracket;

a cable attached to said first glider and extending in a path around said first pulley, said second pulley and a rotatable cable drive means which moves said cable upon rotation of said cable drive means; and a torsion spring directly coupled to said first bracket and to said second pulley, said torsion spring causing said second pulley to move relative to a first point on said bracket to maintain tension in said cable.

20. A window regulator assembly comprising, in combination:

a first glider attached to a windowpane and slidably mounted to an elongated first track;

a first pulley attached proximately to a first end on said first track;

a first bracket mounted proximately to a second end on said first track;

a second pulley rotatably coupled to said first bracket;

a cable attached to said first glider and extending in a path around said first pulley, said second pulley and a rotatable cable drive means which moves said cable upon rotation of said cable drive means; and a torsion spring directly connected to said first bracket and to said second pulley, said torsion spring causing said second pulley to move relative to a first point on said bracket to maintain tension in said cable.

* * * * *